United States Patent [19]

Martin

[11] 4,268,028

[45] May 19, 1981

[54] AUTOMATIC SHEET HANDLING APPARATUS

[76] Inventor: Merrill D. Martin, No. 2 Mall Ct., Oakland, Calif. 94611

[21] Appl. No.: 85,808

[22] Filed: Oct. 17, 1979

Related U.S. Application Data

[60] Continuation-in-part of Ser. No. 860,886, Dec. 15, 1977, abandoned, which is a division of Ser. No. 771,845, Feb. 26, 1977, Pat. No. 4,099,712.

[51] Int. Cl.[3] ..... B65H 29/50; B65H 31/38

[52] U.S. Cl. ..... 271/201; 271/221

[58] Field of Search ..... 271/184, 201, 221, 222, 271/225, 210, 223, 224, 248, 253, 254, 255, 236, 238, 240, 249, 250; 192/129 R, 129 A; 414/36, 28, 84, 87, 88

[56] References Cited

U.S. PATENT DOCUMENTS

| | | | |
|---|---|---|---|
| 958,798 | 5/1910 | Fischer et al. | 271/222 |
| 1,141,277 | 6/1915 | Smith | 271/201 |
| 2,341,021 | 2/1944 | Curtis | 271/221 X |
| 2,387,863 | 10/1945 | Turner | 271/222 X |
| 2,781,195 | 2/1957 | Holloway et al. | 192/129 R X |
| 3,030,867 | 4/1962 | Wright | 414/36 X |
| 3,698,707 | 10/1972 | Lucas | 271/201 X |

*Primary Examiner*—Bruce H. Stoner, Jr.
*Attorney, Agent, or Firm*—George B. White

[57] ABSTRACT

In the herein automatic conveyor system for conveying corrugated cardboard sheets from a sheet making machine or the like, the sheets are delivered to a stacker conveyor and the aligning system for the sheets in the stack includes back-stops spaced from the stacker end of the stacker conveyor and against which the sheets are discharged from the conveyor, adjustable side aligners, adjustable against the opposite side edges of the sheets in the stack, and a flexible longitudinal aligner opposite the back-stops with a mechanism for flexing the longitudinal aligner against the sheets sequentially from one end to the other along its length. The longitudinal aligner includes a plurality of longitudinally spaced rollers along a flexible plate and coacting cams on a rotating shaft engaged with the rollers, the cams being circumferentially offset relatively to one another sequentially so as to push adjacent portions of the plate toward the sheets sequentially from end to end as the cams are rotated. Resilient element draw the plate and rollers toward the cams. There is also a safety device actuated when movement of the back-stops is obstructed including articulated braces extended from the support for the back-stops and resiliently held in extended position so that when the back-stops strike an obstruction during the downward movement of the stacker end, the articulated braces buckle and actuate a switch to first raise the back-stops and then stop the stacker operation.

11 Claims, 23 Drawing Figures

B

AUTOMATIC SHEET HANDLING APPARATUS

BACKGROUND OF THE INVENTION

This is a Continuation in Part of Application Ser. No. 860,886 filed Dec. 15, 1977, now abandoned, which in turn is a division of application Ser. No. 771,845 filed FEB. 26, 1977 now U.S. Pat. No. 4,099,712.

This invention generally pertains to the type of apparatus or system for handling sheets as shown in U.S. Pat. Nos. 3,658,322, 3,880,420, 3,912,258, 3,992,001 and 3,997,155.

The primary object of the invention is to provide such a sheet handling system which can accelerate the handling of the sheets and in which the changing from one size sheet to another size can be rapidly and automatically accomplished.

Particularly it is an object of the invention to provide accurate sensors at the back-up aligning device, at the transfer conveyor snubber, at the back-stop at the stacker end of the stacker and at the side aligners at the stacker end of the stacker whereby respective electric circuits accurately control the actuation of adjustment of the respective devices to the respective dimensions of the sheets; and further to provide said control in such a manner that the adjustment can be pre-set and then by a very simple circuit closing operation by the operator the adjusting actuation to the dimensions of the sheets can be performed without stopping the operation of the corrugator or the sheet conveying and stacking.

Another object of the invention is to provide accurate sheet aligning devices at the stacker end of the stacker conveyor at both side edges of the sheets as well as at the back-stop.

Another object of the invention is to provide the safety device at the stacker end of the stacker conveyor which will automatically stop the stacking in the event the back-stops are abutting against the top of the stack or on a person.

DETAILED DESCRIPTION

Figure 1:
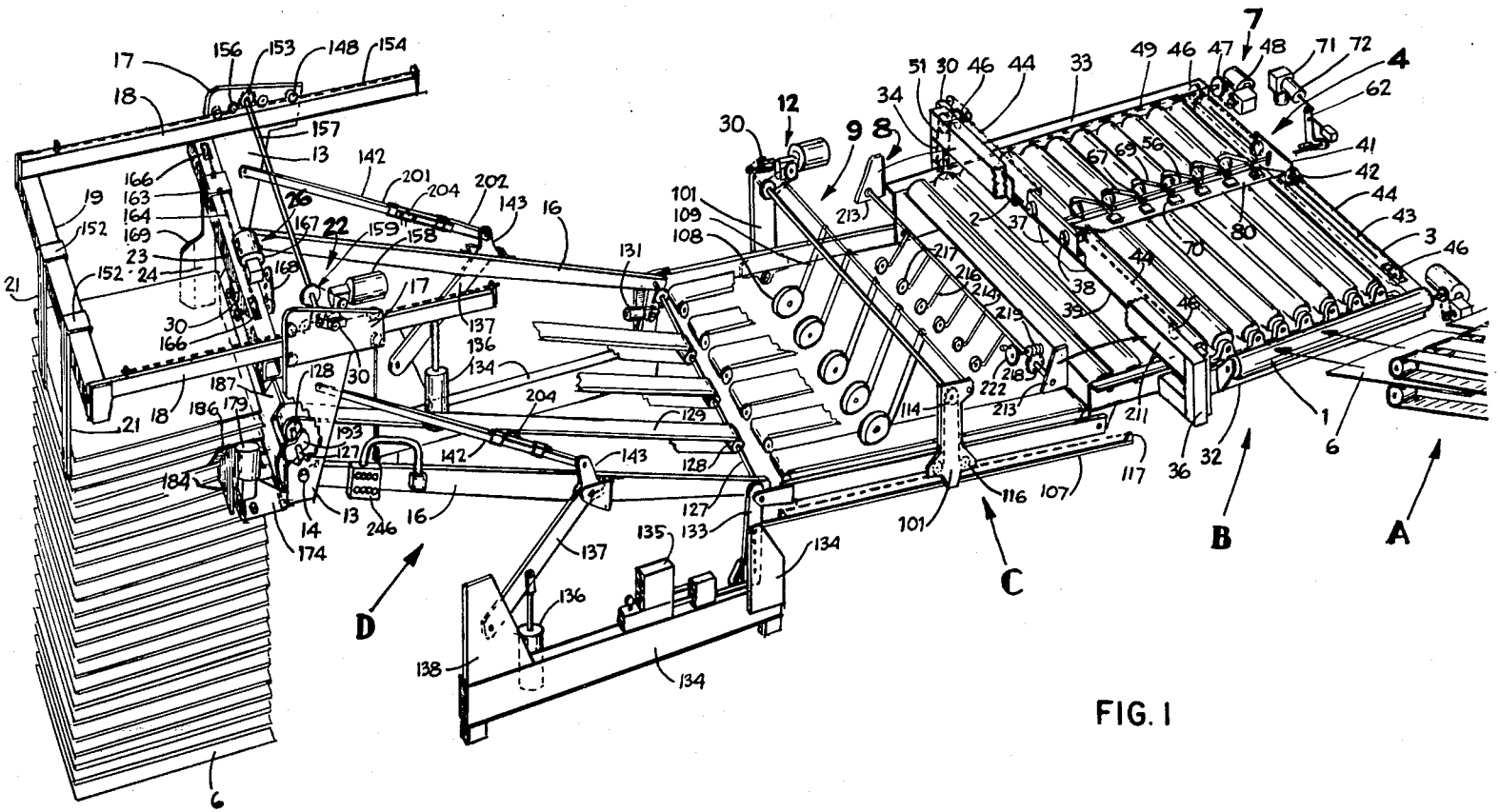
FIG. 1 is a somewhat diagramatic perspective view of the conveyor system with certain of the devices shown spaced from their operating positions for clarity.
Figures 2, 3:
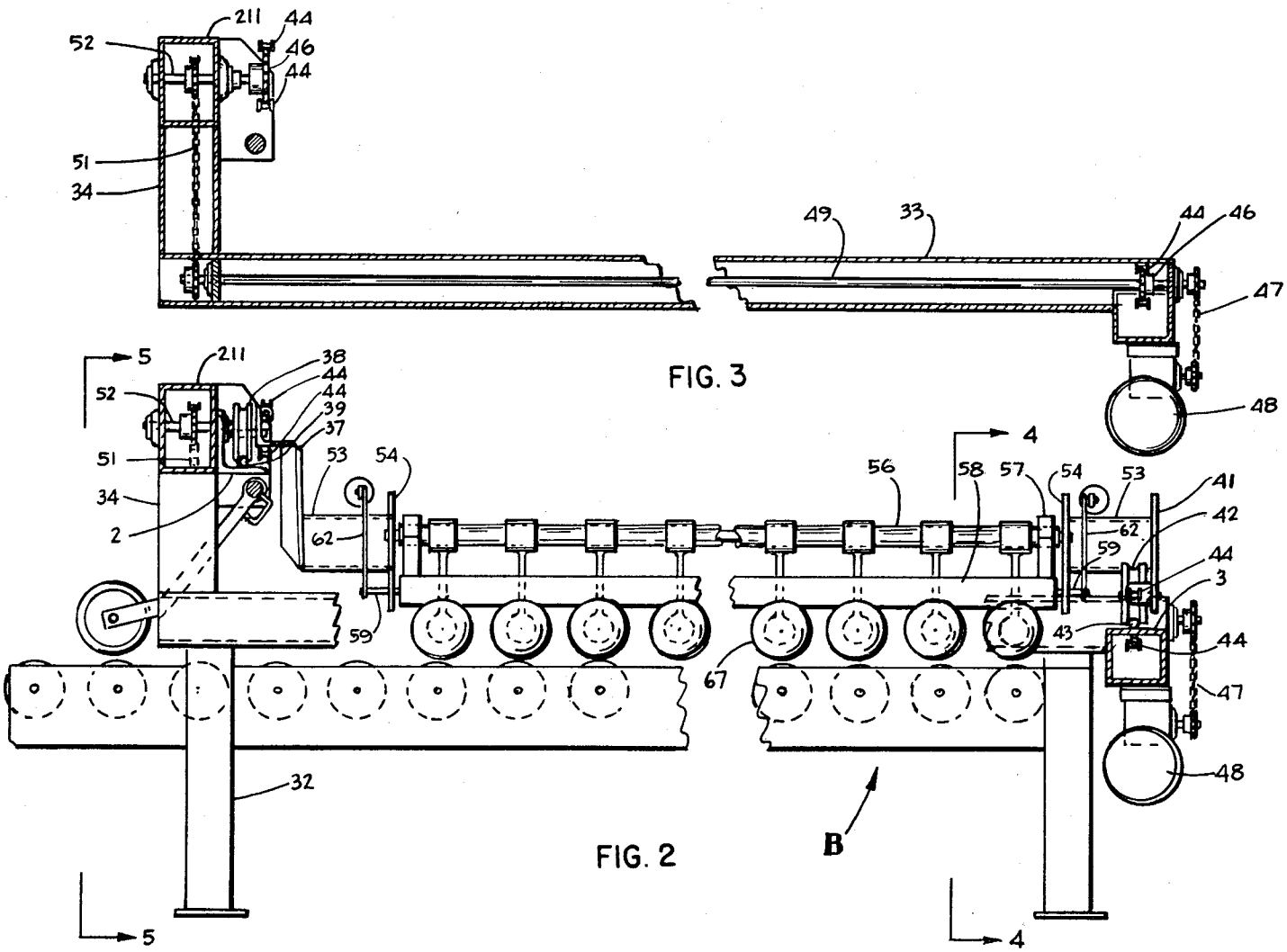
FIG. 2 is a view of the back-up device above the right angle roller conveyor showing its over-head support and the driving mechanism for the adjustment of the back-up device.
FIG. 3 is a sectional view of the casing in which the driving means for the adjustment of the back-up device are contained.
Figure 4:
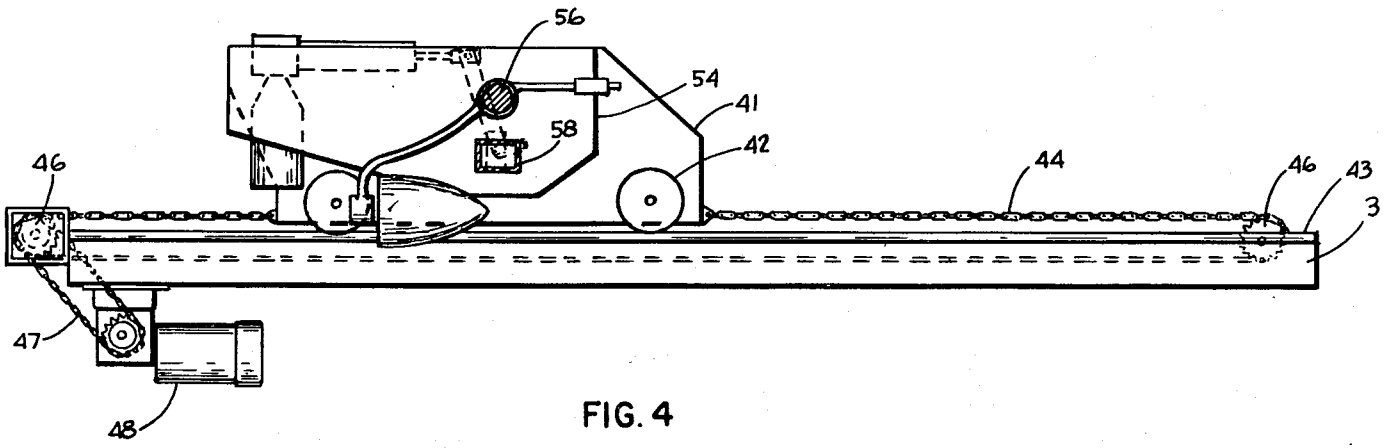
FIG. 4 is a side view in the direction of the arrows 4—4 of FIG. 2.
Figure 5:
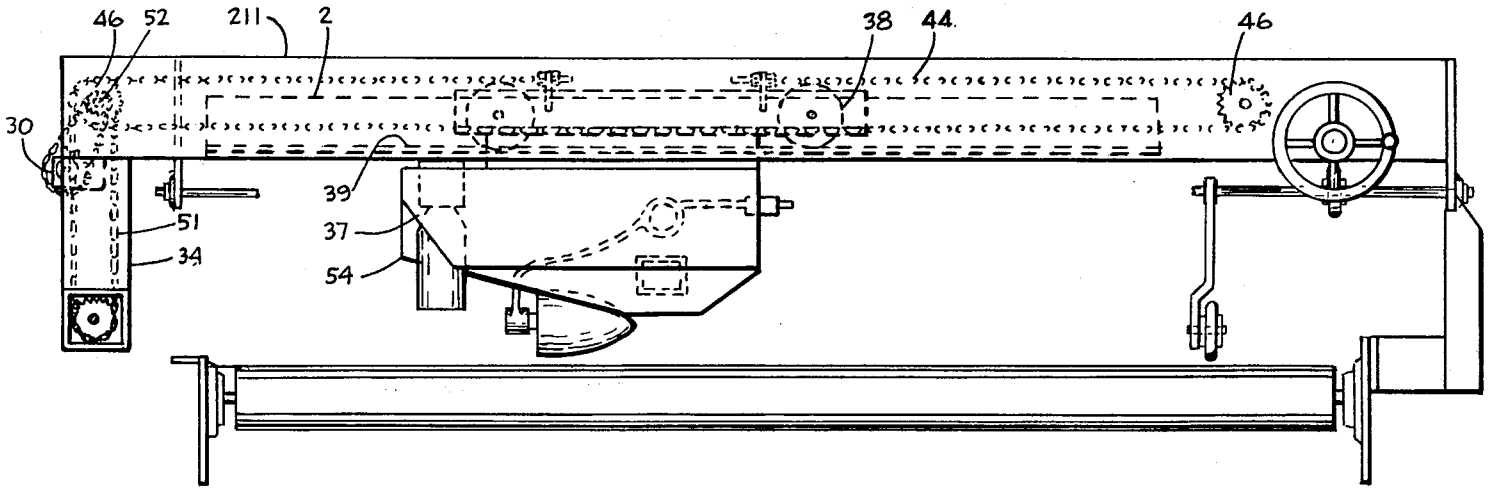
FIG. 5 is a partly sectional side view of the back-up aligning device on the roller conveyor taken on lines 5—5 of FIG. 2.
Figure 6:
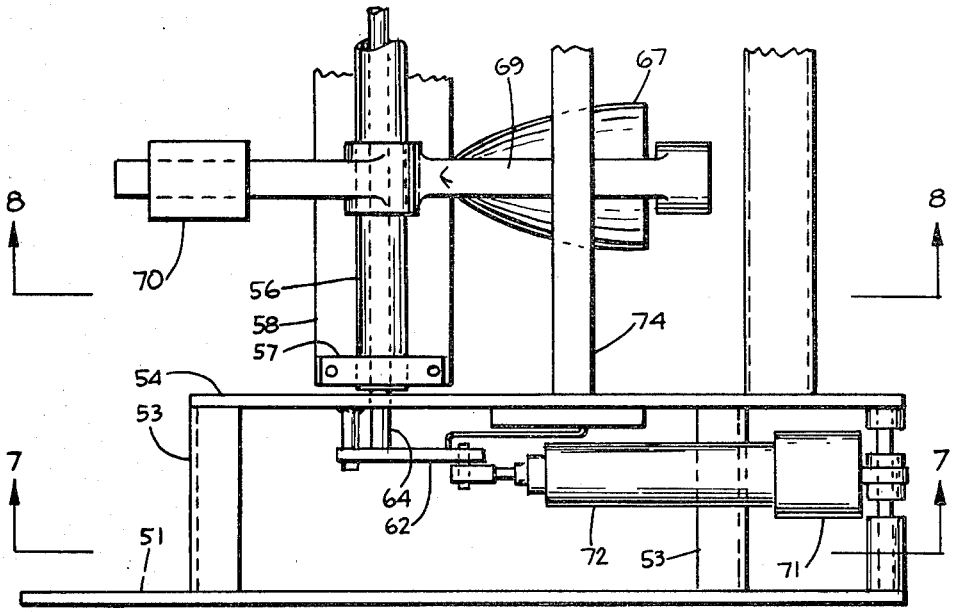
FIG. 6 is a fragmental plan view of the back-up device showing the perpendicular adjusting mechanism for each end of the back-up device.

The general organization of the system includes a delivery conveyor A which usually is a sandwich conveyor and which ejects the sheets, usually multiple cut, on a right angle side roller conveyor B, from which the sheets are transmitted to a transfer conveyor C and then to a stacker conveyor D, at the stacking end of which the sheets are stacked as shown in FIG. 1. Between the delivery conveyor A and the right angle side conveyor B is an accelerating roller 1 to eject the sheets into the right angle side conveyor.

Above the right angle side conveyor B, on parallel supporting frames 2 and 3, is suspended a back-up device 4, spaced from the accelerating roller 1 so as to accommodate the length of the sheets 6 delivered from the delivery conveyor A. An adjusting device 7, to be hereinafter described, is capable when actuated to adjust the back-up device away from or toward the accelerating roller 1 to the length of the cut sheets 6.

At the delivery end of the right angle side conveyor B and supported on the adjacent angle frame 2 is a snubber unit 8 to engage the bundles of sheets to be discharged from the right angle side conveyor B.

Figure 11:
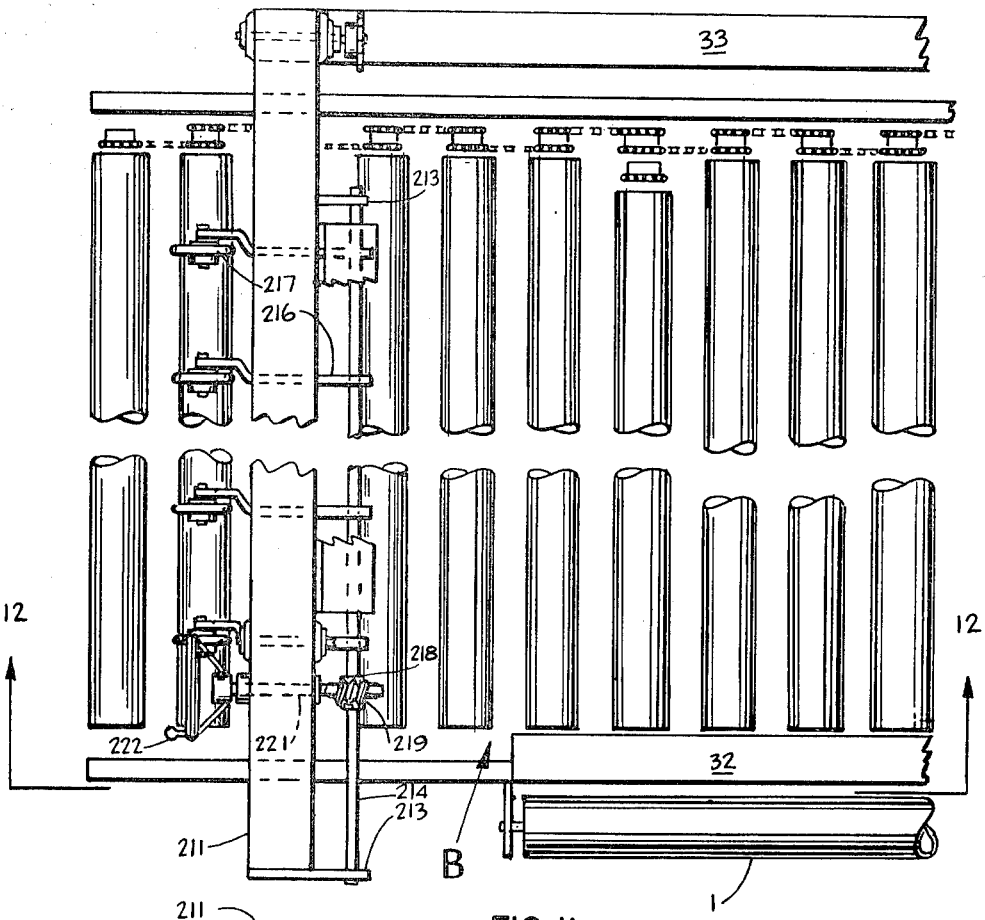
FIG. 11 is a fragmental top plan view of the right angle roller conveyor with the back-up device removed and showing the snubbers at the delivery end of the roller conveyor.
Figure 12:
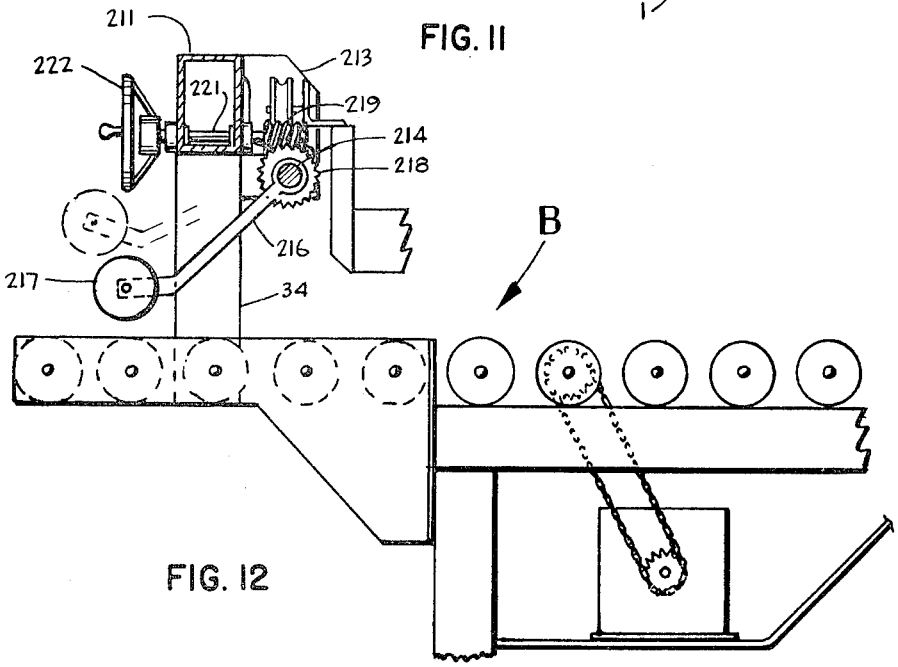
FIG. 12 is a sectional view taken on lines 12—12 of FIG. 11 with the back-up deive broken away.
Figure 13:
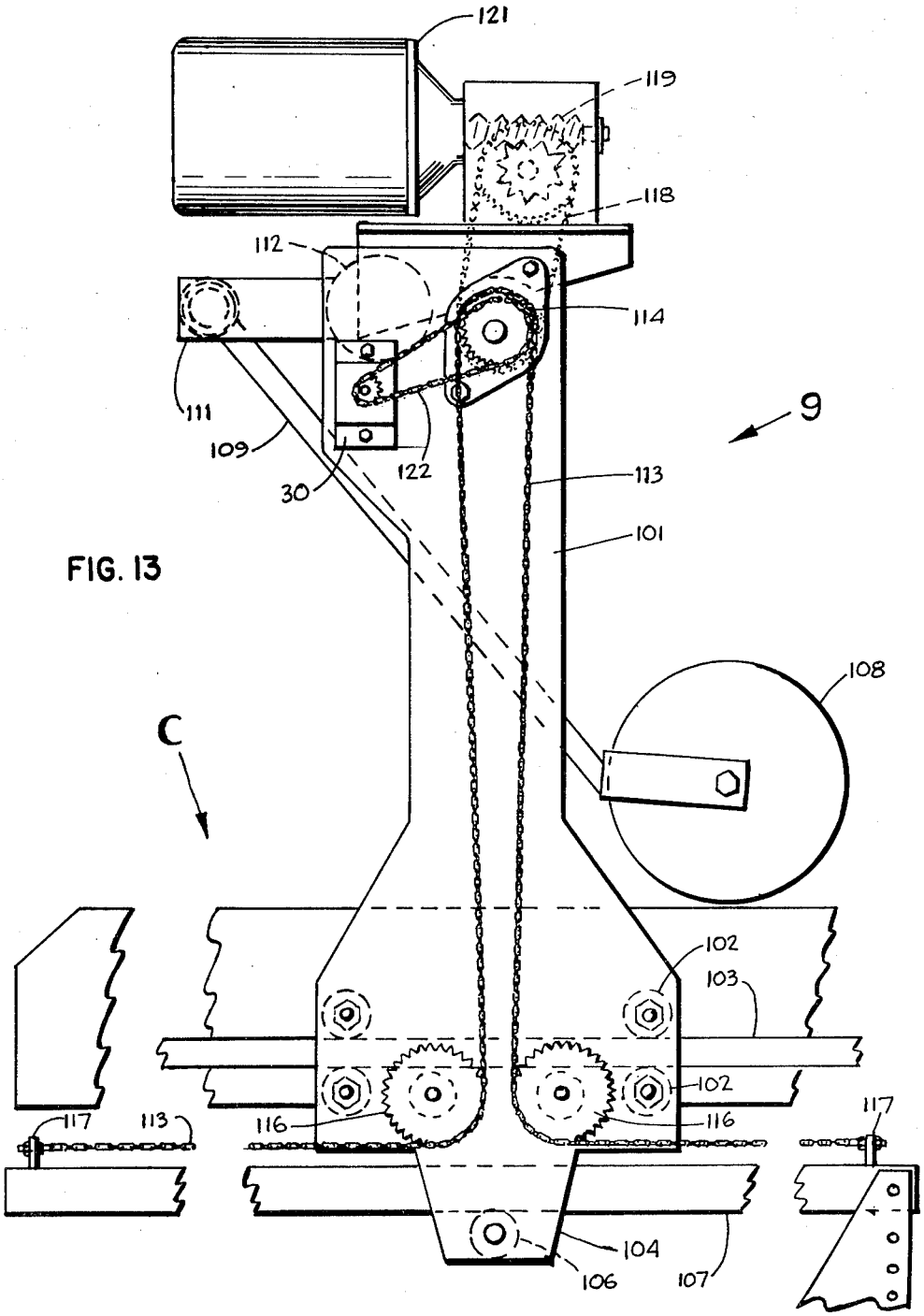
FIG. 13 is a side view of the snubber support and snubbers on the transfer conveyor.
Figure 14:
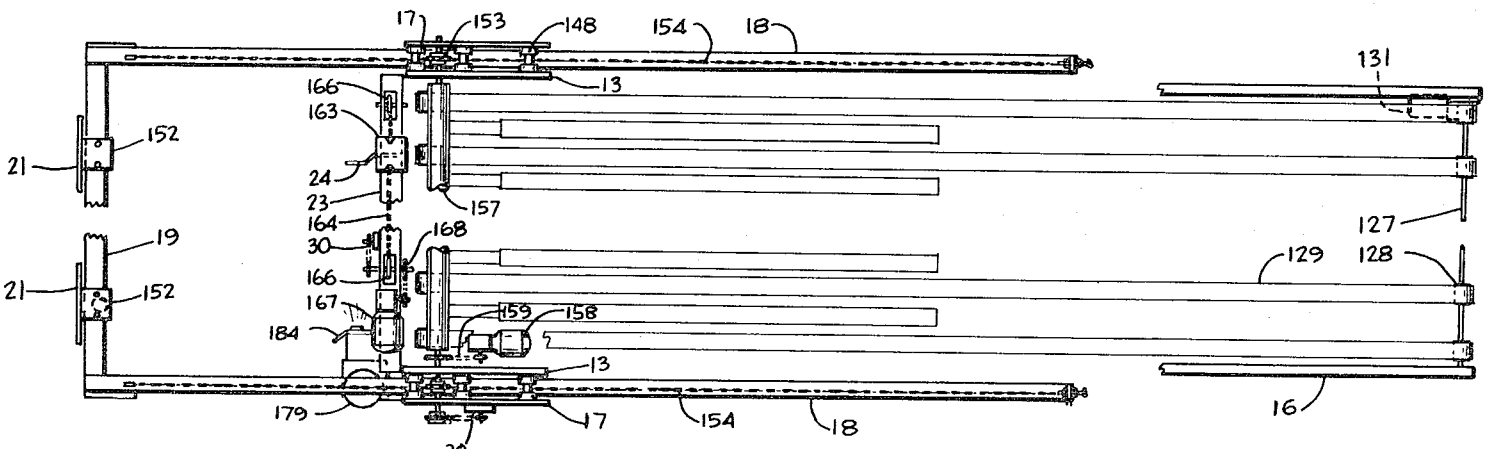
FIG. 14 is a plan view of the stacker conveyor shown somewhat diagramatically.
Figure 15:
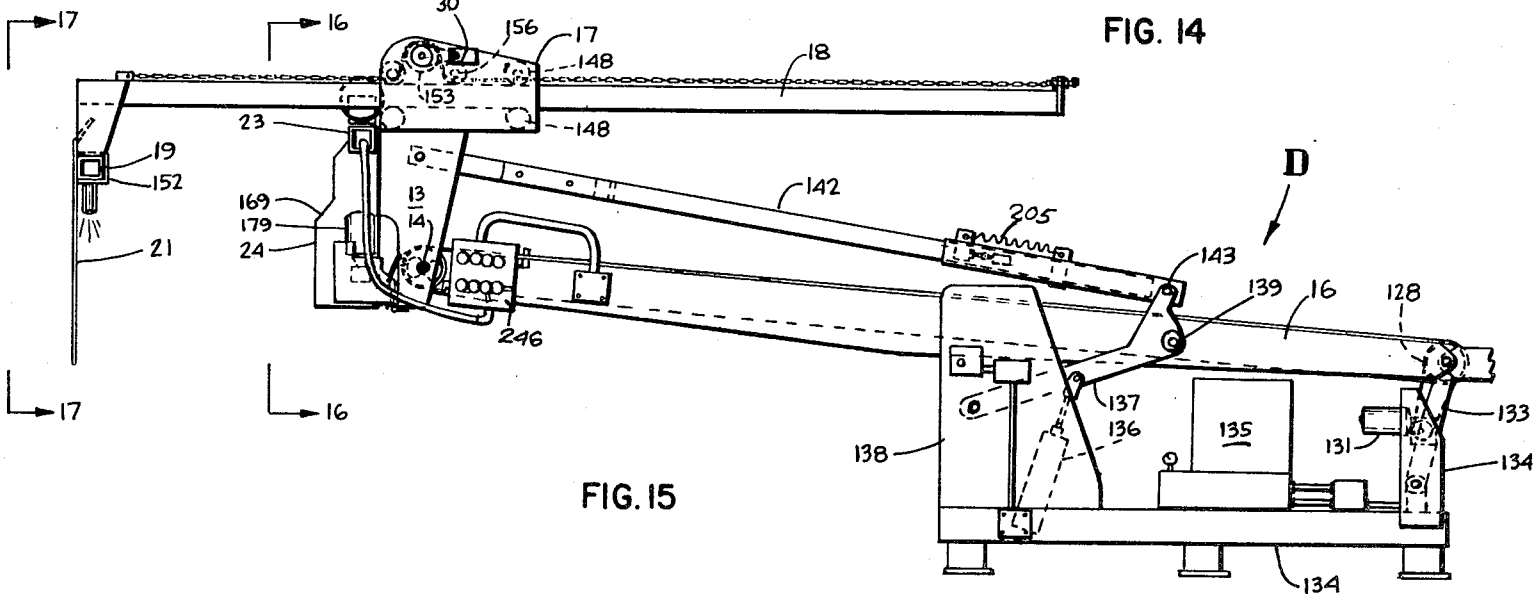
FIG. 15 is a side view of the stacker conveyor.
Figure 16:
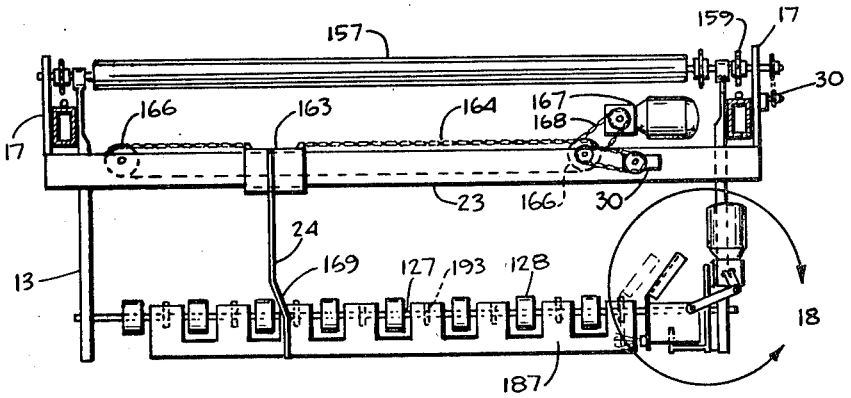
FIG. 16 is an end view of the stacker conveyor with the back-stops removed.
Figure 17:
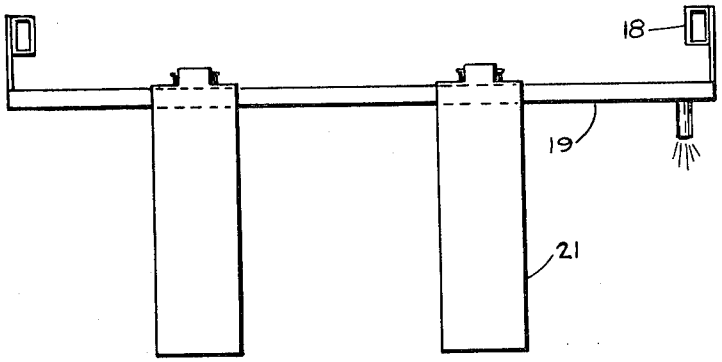
FIG. 17 is an end view of the removed back-stops.

The snubber device 8 above the delivery end of the side conveyor B is supported on bracket plate 213 on the hollow bar 211 spaced above the conveyor B. A shaft 214 is journalled in the bracket plates 213 and supports snubber arms 216 carrying snubber rollers 217. A gear 218 on the shaft 214 is locked by a worm 219 on a shaft 221 journalled in the walls of the hollow bar 211. A hand wheel 222 on the shaft 221 is for manipulation for raising or lowering the snubber arms 216 and snubber rollers 217, as shown in FIGS. 11 and 12.

Above the transfer conveyor C is another snubber device 9 the brackets 101 of which contain an adjusting device driven by a motor and a worm and gear transmission 119 to adjust the distance of the snubber device 9 from the right angle side conveyor B in accordance with the width of the sheets 6.

On the stacking end of the stacker conveyor D are a pair of side brackets 13 each pivoted about a pivot support 14 on the frame 16 of the stacker conveyor. On the head 17 of each bracket 13 is slidably supported a carrier bar 18. The carrier bars 18 are connected at the outer ends by a cross bar 19 on which latter are supported back-stops 21 against which the sheets are stacked. An adjusting device 22 including a geared motor is provided to move the carrier bars 18 on the heads 17 so as to correctly space the back-stops 21 from the stacker end of the stacker conveyor D according to the width of the sheets 6 stacked.

The brackets 13 are connected by a tubular cross bar 23 on which is adjustably supported a side edge aligner 24, on the same side of the stacker conveyor as and substantially in registry with the back-up device 4 whereby the side edge aligner 24 and the back-up device 4 are adjusted to the same width of the sheets 6. An adjusting device 26 on the cross bar 23 so engages the edge aligner 24 as to move the edge aligner along the cross bar 23 to the adjusted position.

The raising and lowering of the stacker conveyor D is accomplished through the hydraulic mechanism described in U.S. Pat. No. 3,321,202 in which cam actuators adjust and operate the respective valves in a hydraulic system for raising and lowering the stacker conveyor D.

Figure 23:
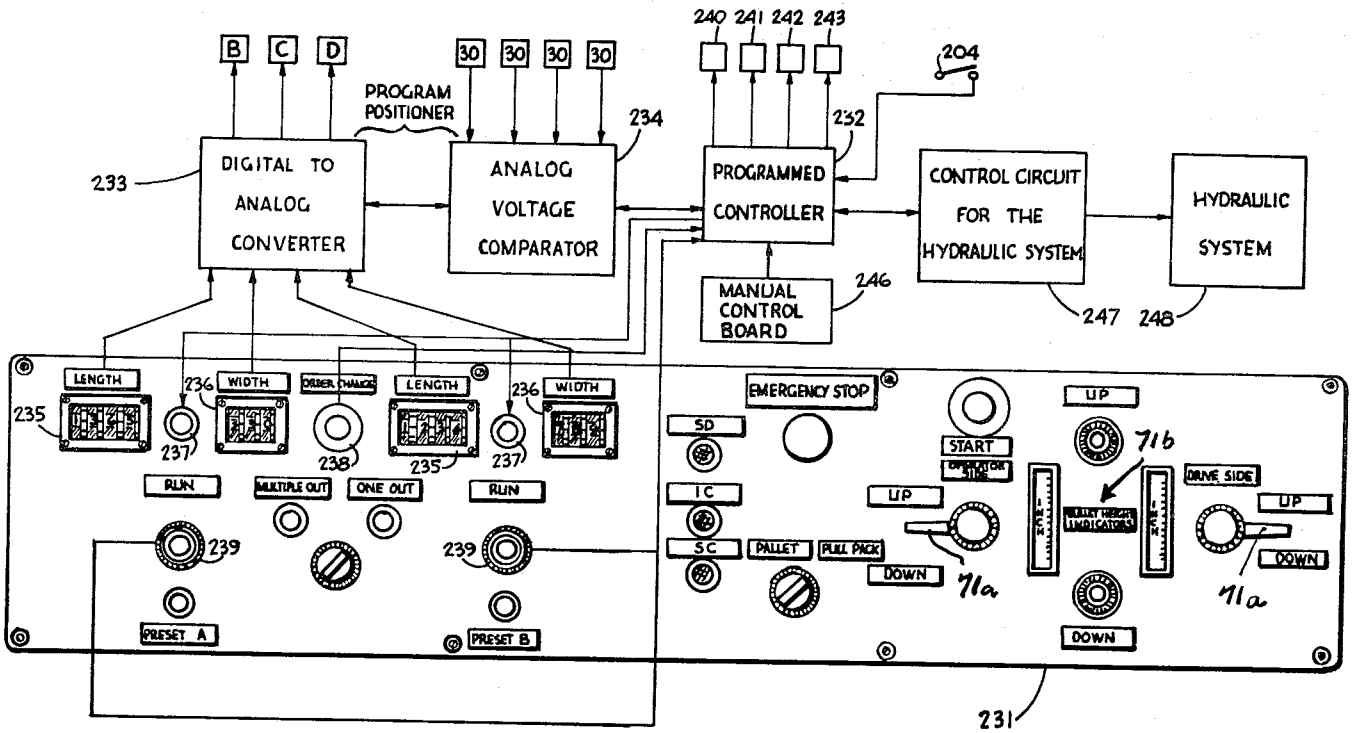
FIG. 23 is a view of the control board and the wiring diagram for the automatic operation.

The adjusting device 7 for the back-up device 4, the adjusting device 12 for the snubber device brackets 101 above the transfer conveyor C, the adjusting device 22 for the distance adjustment of the back-stops 21, and the adjusting device 26 for adjustment of the side edge aligner 24, are connected each by a sensor, in this illustration a ten point potentiometer 30 into circuits illustrated in the wiring diagrams in FIG. 23, whereby the relative positions of the respective devices are sensed and whereby the adjusting devices respectively are operated to travel in a direction and to a distance to conform to the respective dimensions of the sheets. On a control panel 231, shown in FIG. 23, are the various switches and instruments to be hereinafter described, to set the respective adjustments and to close or open the respective actuating circuits so as to convey commands to the respective adjusting devices to perform the respective adjustments.

The Back-Up Device

As shown in FIGS. 1 to 10, inclusive the lower tubular frame 3 is supported directly on the frame 32 of the side conveyor B and extends transversely to the conveyor B. At the end of the frame 3 farthest from the delivery conveyor A is a hollow cross bar 33, from the far end of which extends upwardly a perpendicular casing 34. The upper angle frame 2 is on the hollow bar 211 which extends from the casing 34 parallel with the lower tubular frame 3 and is supported at its other end on a bracket 36 extended from the frame of the side conveyor B. A carriage bracket 37 has wheels 38 thereon riding on a rail 39 on the upper angle frame 2. An opposite carriage bracket 41 has wheels 42 riding on a rail 42 on the tubular lower frame 3.

Each carriage bracket 37 and 41 is drawn by a chain 44 the ends of which are secured to opposite ends of the respective carriage bracket. Each chain 44 is played over spaced sprockets 46 so that as one of the sprockets is rotated it correspondingly pulls the respective carriage bracket. The shaft on one of the sprockets 46 at the lower frame 3 is connected by a chain and sprocket transmission 47 to a geared drive motor 48 of the adjusting device 7. The lower drive sprocket 46 drives a transmission shaft 49 in the hollow cross bar 33, and drives a perpendicular chain and sprocket transmission 51 in the perpendicular casing 34. The shaft 52 of the top sprocket of transmission 51 drives the adjacent chain sprocket 46 of the upper chain 44. Thus, the carriage brackets 37 and 41 are moved in synchronism.

Figure 7:
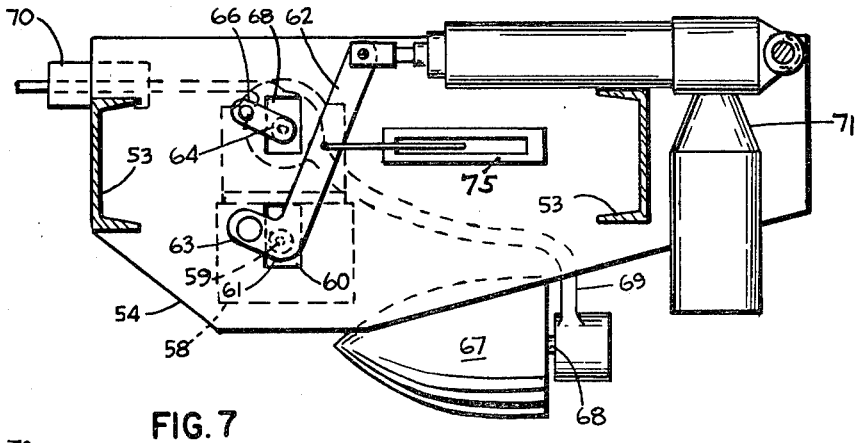
FIG. 7 is a partly sectional view, the section being taken on lines 7—7 of FIG. 6.

Spacers 53 extend inwardly from each carriage bracket 37 and 41 and each supports an end plate 54. A tubular shaft 56 between the end plates 54 is supported in brackets 57 extended from a hollow bar 58, which latter has a stub shaft 59 extended from each end thereof through an elongated slot 60, as shown in FIG. 7. The stub shaft 59 is supported in the heel 61 of a bell crank lever 62. The toe of the shorter arm 63 of the bell crank lever 62 is pivoted on a pivot on the outside face of the adjacent end plate 54. Another shaft 64 extended from each end of the tubular shaft 56 is in another perpendicular slot 68 and is supported on a short link 66 pivoted on the outside face of the end plate 54.

The back-up device includes abutment elements 67, each of which is rotatably supported on a pin 68 on the end of a lever 69 journalled on the tubular shaft 56. A counterbalance, such as a counterweight 70 on the arm of the lever 69 beyond its journal determines the pressure of each abutment on the edges of sheets 6 lying on the respective rollers of the side conveyor B.

The entire abutment assembly can be adjusted so as to provide gradually increasing spacing under the abutment elements 67 toward the discharge end of the side conveyor B, to accommodate sheets bundled step by step in multicut sheet handling. Such adjustment is accurately accomplished as shown in FIG. 7 at each end by an electric geared motor 71, mounted between the adjacent carrier bracket and end plate, which moves a plunger 72 connected to the longer arm of the bell crank lever 62. In this manner the respective stub shaft 59 and the end of the hollow bar 58 are raised or lowered, correspondingly raising or lowering the respective end of the abutment assembly. The motor 71 is also controlled by an "up and down" switch **71*a* shown on the right hand side of FIG. 23. A potentiometer 75 connected to a bullet height indicator 71*b*, next to switch 71*a* in FIG. 23** indicates the height adjustment of the abutment assembly.

Figure 8:
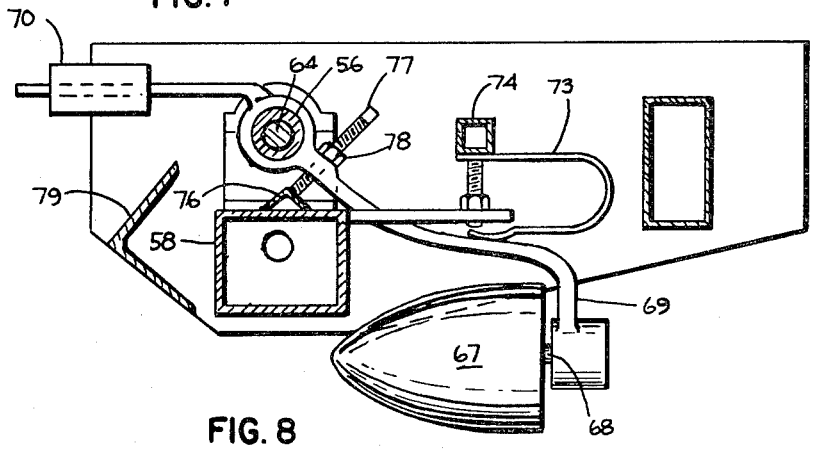
FIG. 8 is a partly sectional view, the section being taken on lines 8—8 of FIG. 6.

For cushioning each abutment element, a leaf spring 73, above each abutment lever 69 is mounted on another cross-bar 74 so as to bear against the lever 69, as shown in FIG. 8, and inhibit excessive vibration of the abutment element 67. On a projection 76 on the hollow bar 58 rests a threaded pin 77 screwed through each abutment lever 69. A limit nut 78 on each threaded pin 77 adjustably determines the spacing of the abutment element from the rollers of the side conveyor B.

Figure 9:
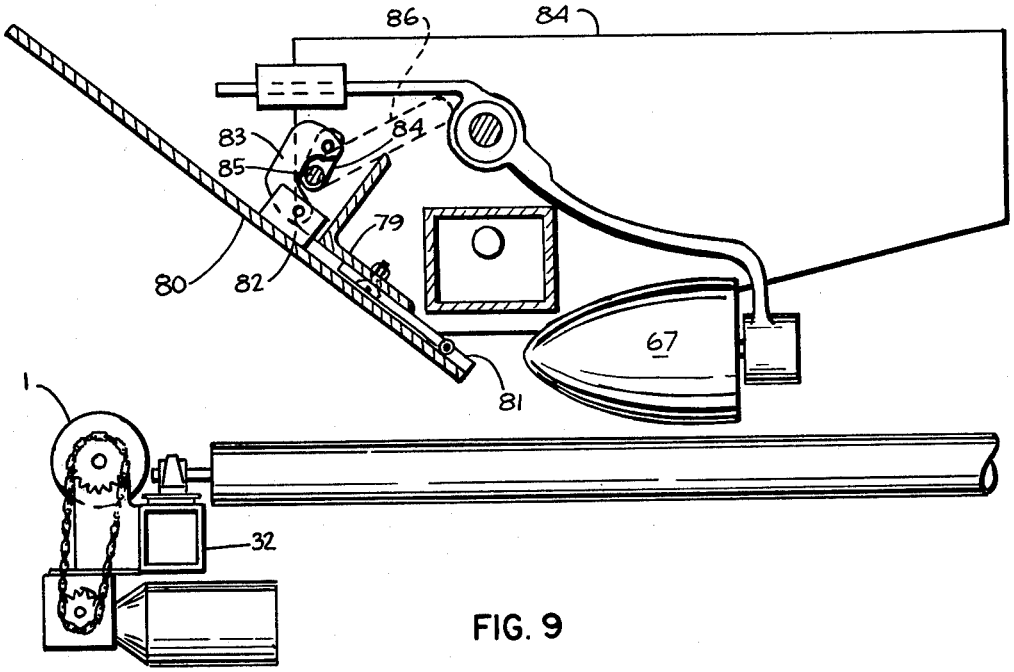
FIG. 9 is a partly sectional view for illustrating the position of the deflector plate in elevated position.
Figure 10:
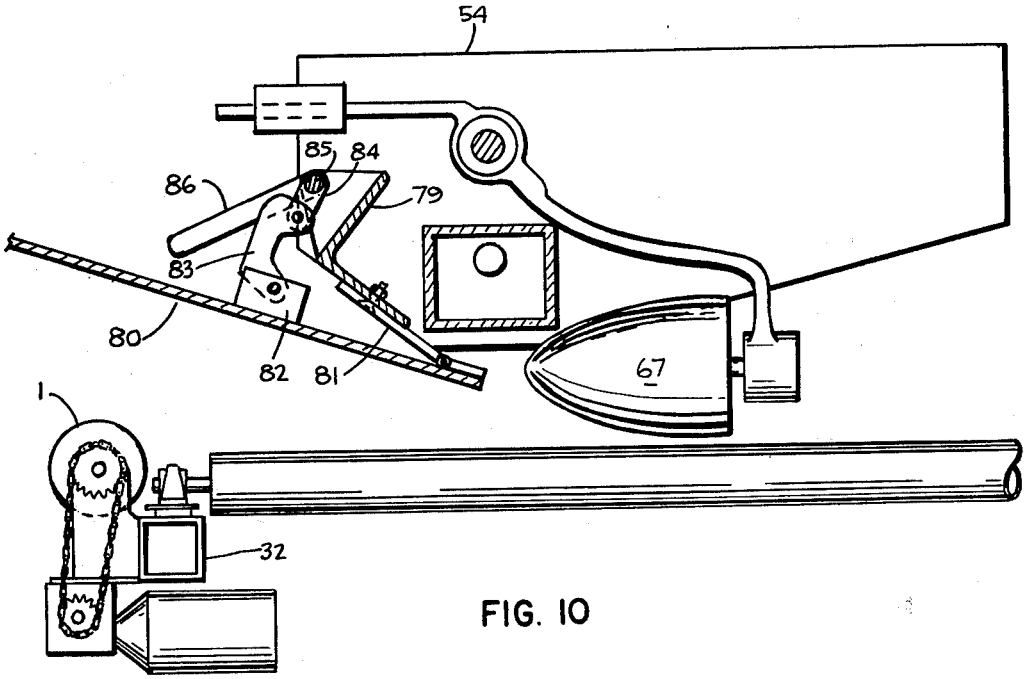
FIG. 10 is a side view showing the deflector plate in the lower position.

Between the end plates 54 is an angle iron 79 on which is supported a deflector plate 80. The lower edge of the deflector plate 80 is on a hinge 81. At each end of the deflector plate 80 is an ear 82 extending toward the angle iron 79. An end of a link 83 is pivoted on each ear 82. The other end of the link 83 is pivoted on a toggle 84 on a shaft 85, journalled in the end plate 54 and has a handle 86 thereon, as shown in FIGS. 9 and 10. By turning the handle 86 counter-clockwise from the position shown in FIG. 9 into the position shown in FIG. 10, the deflector plate 80 is lowered to accommodate shorter sheets.

The Snubber Device on the Transfer Conveyor

The snubber device 9 above the transfer conveyor C generally is the same as described in U.S. Pat. No. 3,992,001. Each of a pair of spaced brackets 101 is supported on two sets of rollers 102 at its lower end which ride on a guide rail 103 on the side frame of the transfer conveyor C. From this lower end extends an ear 104 with a roller 106 therein guided on a stationary bar 107. As the transfer conveyor C travels during the compensating movements of the stacker conveyor D the guide rail 103 travels between the rollers 102. The snubber wheels 108 are supported on snubber arms 109 pivoted on bracket extensions 111, extended from a cross bar 112. An adjusting chain 113 extends around a top sprocket 114 and then downwardly along the bracket 101 and around idler sprockets 116 and then in opposite directions and has its ends connected to anchors 117 spaced oppositely from the bracket 101. Thus when the top sprocket 114 is rotated in selected direction it rotates the idler sprockets 116 in such a way that the bracket 101 travels in the respective directions relatively to the stationary support 107 and thereby adjusts the location of the snubber wheels 108 in accordance with the respective dimension of the sheets 6 on the transfer conveyor C. The upper sprocket 114 is driven by a sprocket and chain transmission 118 which latter is driven by a self-locking worm and gear transmission 119 driven by an electric motor 121 actuated in accordance with the control through a potentiometer 30 connected by chain and sprocket 122 to one of the top sprockets 114. Whenever the motor 121 turns the worm and gear transmission 119, the top sprocket 114 pulls the adjusting chain 113 around the idler sprockets 116, thereby pulling the brackets 101 into the selected adjusted position according the size of the sheets on the transfer conveyor C.

The Stacker

The stacker conveyor D, shown in FIGS. 14 through 22, is based on the Automatic Sheet Stacker shown and described in U.S. Pat. No. 3,321,202, with new sheet aligning devices and safety controls.

A shaft 127 extends between the side frames 16 bearing conveyor pulleys 128 for the conveyor belts 129, driven at one end by a geared electric motor 131. The intake ends of the stacker side frames 16 are supported on arc compensating rocking arms 133 pivoted on base frames 134. A hydraulic plunger 136 on the base frame 134 is connected to a lifting arm 137 an end of which is pivoted on a bracket 138 on the stationary base frame 134. The lifting arm 137 has its heel 139 pivoted on the adjacent stacker side frame 16 spaced from the respective rocker arms 133 so that as the stacker conveyor is raised by the plunger 136 the stacker end thereof is moved on a straight perpendicular plane. The plunger 136 arm actuated by a hydraulic system including cams and valves as shown in FIGS. 11 through 16 of said U.S. Pat. No. 3,321,202, indicated in FIG. 15 herein at 135, for raising and lowering the stacker end of the stacker conveyor as described in said patent. On the stacker end of each side frame 16 is pivoted one of the perpendicular side brackets 13. A connecting brace 142 connects the middle of each side bracket 13 to an ear 143 extending upwardly from the heel 139 of the lifting arm 137 for maintaining the side brackets 13 in perpendicular attitude as the stacker end is raised and lowered.

The Stack Aligning Devices

The carrier bars 18 are supported on the respective bracket heads 17 on rollers 148. On the ends of the carrier bars 18 beyond the stacker end of the stacker conveyor is mounted the cross bar 19. The back-stops 21 are abutment plates and are supported on the cross bar 19 facing the stacker end of the stacker conveyor so that the sheets ejected from the stacker conveyor abut the back-stops 21 for forming a stack. The mountings 152 of the plates of the back-stops 21 are manually adjustable longitudinally along the cross bar 19.

The spacing of the back-stops 21 from the stacker end of the stacker conveyor for sheet size is accomplished by moving the carrier bars 18 on the heads 17. Above each carrier bar 18 on each head 17 is a sprocket 153 on which is a chain 154, which extends below idler sprockets 156 and then along the adjacent carrier bar 18 in opposite directions and has its ends secured to said carrier bar 18. The opposite drive sprockets 153 are connected by a drive shaft 157. A geared electric drive motor 158 through a transmission 159 drives the drive sprockets 153 for moving the carrier bars 18 for adjusting the distance of the abutment plates of the back-stops 21 from the stacker end of the stacker conveyor to the size of the sheets. A potentiometer 30 controls such adjustment.

The side edge aligner 24 is a plate and is suspended from the tubular cross bar 23 in a plane substantially at right angles to the plates of the back-stop 21. Sleeve 163 on the tubular cross bar 23 supports the edge aligner 24. The adjusting device 26 includes a chain 164 which has its ends attached to opposite ends of the sliding sleeve 163 and extends around spaced sprockets 166 and in the hollow connecting bar 23 from one sprocket 166 to the other sprocket 166. One of the sprockets 166 is driven by a geared electric motor 167 through a transmission 168 for sliding the sliding sleeve 163 thereby adjusting the edge aligner 24 to the size of the sheet 6. The edge aligner 24 has a transverse tapered offset 169 to ease the adjacent edge of the sheet into the top of the stack. The side edge aligner 24 is in registry with the abutment element 67 of the back-up device 4 on the side conveyor B.

Figure 18:
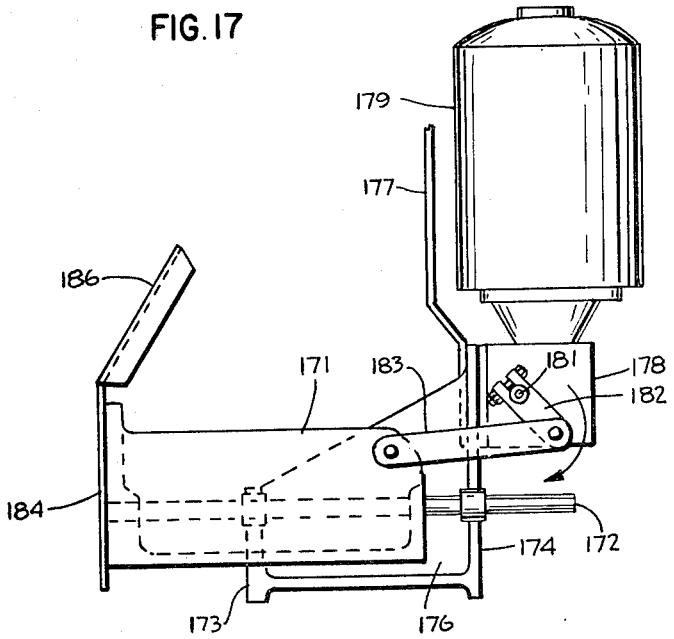
FIG. 18 is a detail of the vibrating edger aligner for the stack.
Figure 19:
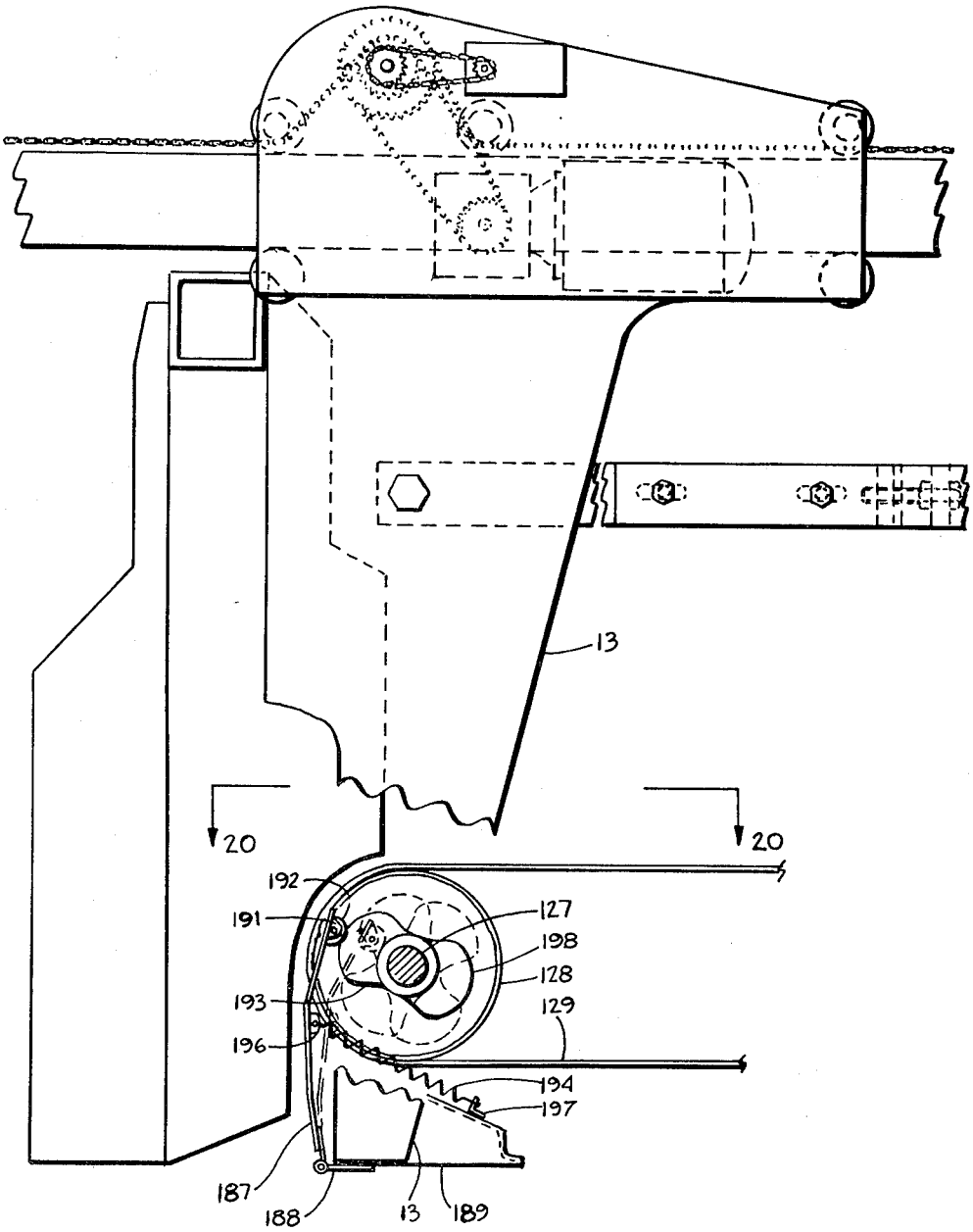
FIG. 19 is a side view of the stacker end of the stacker conveyor partly broken away.
Figure 20:
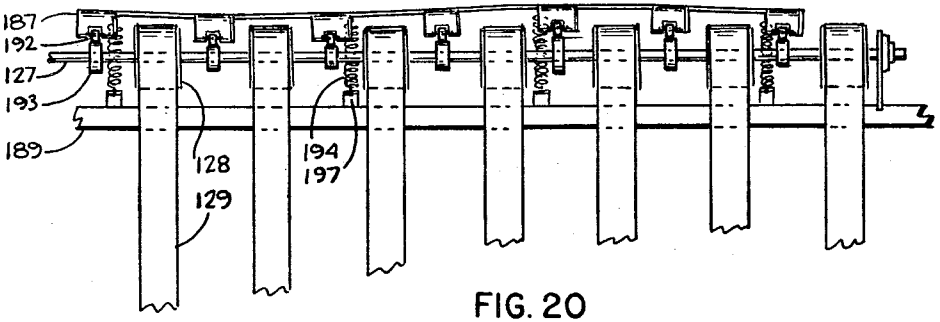
FIG. 20 is a fragmental top view of the stacker end of the stacker conveyor showing the aligning plate and its cam actuation.
Figure 21:
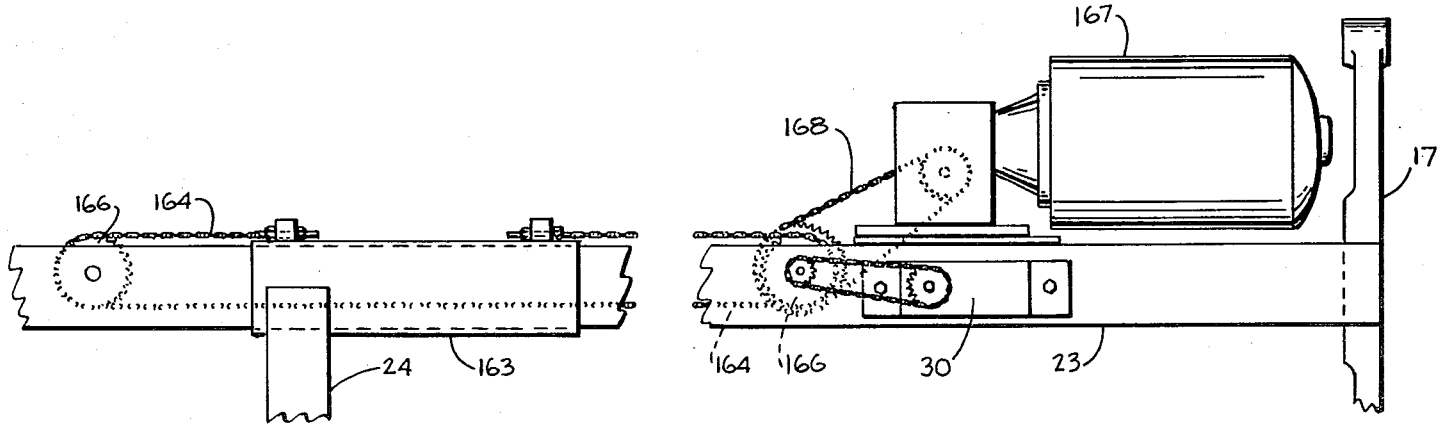
FIG. 21 is a fragmental end view of the top of the stacker end of the stacker conveyor showing the adjusting means for the edge aligning member.
Figure 22:
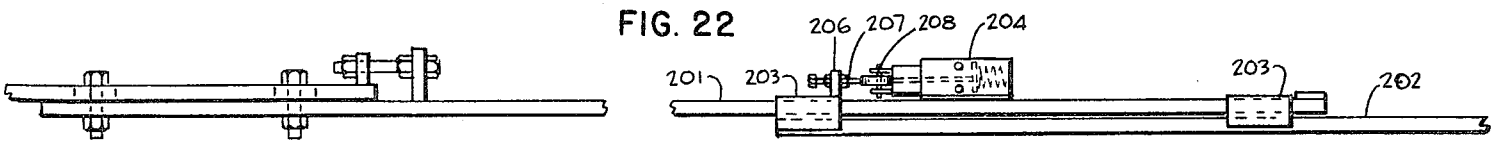
FIG. 22 is a fragmental top plan view of the telescoping bracing bar and the safety switch thereon.

A reciprocating side edge aligner is mounted on the lower portion of the side bracket 13 opposite the adjustable side edge aligner 24. The reciprocating side edge aligner has a reciprocating body 171 which has a shaft 172 extended therethrough and through flanges 173 and 174 of a bracket 176. The flange 174 is mounted on a bracket plate 177. A gear casing 178 is mounted on a bracket 176, as shown in FIG. 18, and supports an electric motor 179. The transmission drive shaft 181 rotates a crank 182, which reciprocates a connecting link 183 connected to the reciprocating body 171. On the free end of the reciprocating body 171 is an aligner plate 184 facing the side edge aligner 24. A deflector flange 186 extends upwardly from the aligner plate 184 to guide the sheets 6 to the top of the stack. The deflector flange 186 is in registry with the curved offset 169 of the side edge aligner 24, whereby the sheets are guided into alignment with the top sheet of the stack. Due to the action of the crank the reciprocation of the aligner plate 184 against the side edges of the sheets in the stack is at variable speed. Namely the retracting stroke of the aligner plate 184 is more rapid than its impact stroke toward the edges of the sheets, so as to align the edges more softly.

The edges of the sheets in the stack at the stacker conveyor end are aligned by an undulating flexible paddle plate 187, the lower edge of which is held by hinges 188 on a transverse stacker frame member 189 beneath the stacker end of the stacker conveyor. The top portion of the paddle plate 187 is inclined toward the stacker conveyor and has longitudinally spaced bearing lugs 191 each holding a roller 192 in contact with an adjacent cam 193. The cams 193 are on the pulley shaft 127 and are located between the respective pulleys 128. Springs 194, each having one end anchored on a lug 196 on the inside face of the paddle plate 187 and the other end on a lug 197 on the frame member 189, yieldably pull the paddle plate 187 so as to urge the rollers 192 against the respective cams 193. The risers 198 of the series of cams 193 are offset circumferentially in series along the paddle plate 187, so that as the cams 193 are rotated they cause the paddle plate 187 to impact the edges of the sheets in the stack sequentially from one end of the sheet to the other thereby urge them against the back stops 21 for straight alignment.

The Safety Device

Each brace 142 for the head 17 is made of two rods 201 and 202 connected by sleeves 203 fixed on the rod 202 through which the other rod 201 is slidable. The rod 201 is connected to the adjacent stacker side bracket 13, as shown in FIG. 1, and the other rod 202 is connected to the upward extension 143 of the lifting arm 137. On the rod 201 is a normally closed spring switch 204. On the sleeve 203 adjacent the spring watch 204 is an ear 206 holding a pin 207 against an arm 208 projecting from the spring switch 204 so as to push the arm 208 into switch opening position. The switch 204 is connected into a control circuit to first raise then hold the stacker in elevated position. Should the back stop accidentally lower on top of a stack or on a person, then the side brackets 13 would be pushed back about their pivots 14, thereby would push the rod 201 and the spring switch 204 away from the pin 207. Thereupon the spring switch 204 will close and will actuate the circuit and devices for the stacker holding means so as to prevent lowering of the stacker end of the stacker conveyor. A spring 205 holds the rods extended.

Automatic Operation

The automatic operation of the device for the herein described adjustments is illustrated in the wiring diagram in connection with an instrument board 231 which is preferably mounted on a separate stand adjacent to a console (not shown) in which are contained a programmed controller 232 and a speed and position programmer including a digital to analog converter 233 and an analog voltage comparator 234 each provided with suitable programmed printed circuits to respond to input impulses and to transmit corresponding commands to the respective operating drives or devices.

On the instrument board there is a usual starting button which is connected to the console to connect the usual electric current to said program controls therein, and thereby to deliver the command to the motors which drive the respective conveyors B, C, and D at their pre-set relative velocities. Such conveyor control is accomplished through the digital and analog converter 233.

For pre-setting and adjusting the back-up device 4 on the side conveyor B, the snubber device 9 above the transfer conveyor C, the adjusting device 22 for the carrier bars 18 for spacing the back-stops 21, and the adjusting device 26 for the side edge aligner 24, the board is provided with two pairs of digital switches 235 and 236 of usual construction, respectively adjustable for the length and width of the sheets to be handled. These digital switches are pre-set for the particular length and width of sheets and are connected to the digital analog converter 233, which relays signals to the programmed controller 232 as to adjustment. The programmed controller acknowledges the "pre-set" by turning "on" the respective indicator "run" lights 237.

There is a suitable analog voltage comparator for each adjusting device to compare the potentiometer voltages according to their positions with the length and width pre-set by the digital switches 235 and 236.

An "order change" switch 238 connected to the programmed controller 232 sets the programmed controller, and a switch 239 for each setting orders the programmed controller to actuate drive circuits 240, 241, 242 and 243 respectively connected to the electric motors respectively driving the back-up device 4, the snubber device 9, the edge aligner adjusting device 26, the carrier bars 18 for the back-stops 21, which move the respective devices to adjust to the respective length and width of the sheets set on the digital switches 234 and 235. The potentiometers 30 heretofore described at each of the adjusting devices are connected to the analog voltage converter 234 and their voltage change indicates the distance travelled by the adjusting devices, and the analog voltage converter relays the information for comparison to the adjusted length and width of the digital switches 234 and 235 and to the programmed controller to stop the operation of the drives 240, 241, 242, and 243 when the measured adjustments indicated on the digital switches 235 and 236 are reached.

The digital to analog converter 233 of the program positioner is so programmed that the changes of the adjustments are made in accordance with the speed of travel of the respective conveyors so that the previous sheets are cleared from the respective conveyors prior to the adjustment for the next sheet size.

A manual control board 246 is provided preferably at the stacker end of the frame 16 of the stacker, the control buttons of which correspond to the various operating devices, the circuits of which are connected to the programmed controller so as to over-ride the automatic control when manual control is required.

The spring switches 204 are also connected to the programmed controller 232 so that when actuated by the telescoping of the rods 201 and 202 the programmed controller 232 directs the respective solenoid switches in the control circuit 247 (shown in FIG. 12 of U.S. Pat. No. 3,321,202) to actuate the respective solenoid valves in the hydraulic system 248 (shown in FIg. 11 of said U.S. Patent) first to raise the stacker end to clear the obstruction and then to hold it raised until the obstruction is removed and the operator manually starts the stacking operation again.

I claim:

1. Means to align the sheets in a stack formed at the stacker end of a stacker conveyor, comprising back-stops spaced from said stacker end against which the sheets are discharged from the conveyor, stack side aligners, means to support each stack side aligner between said stacker end and said back-stops, substantially at right angles to said back-stops thereby to guide the adjacent side edges of said sheets to the stack, a longitudinal flexible aligner element
means to adjustably support said flexible element opposite said back-stops,
and a mechanism on said stacker end to push said flexible element against said sheets sequentially from one end to the other,
said mechanism including a plurality of pusher members longitudinally spaced along said flexible element,
and means to apply sequential pushing movement to said pusher members sequentially along said flexible element toward the sheets in the stack.

2. The means to align the sheets in a stack specified in claim 1, and
means to rotatably support said pushing members,
and resilient means to urge said flexible element and said rotatable pusher members into operative relation.

3. An undulating stack aligner for the stacker end of a stacker conveyor, comprising
a flexible element along said stacker end,
a plurality of individual support elements along said flexible element floatingly to support said element with freedom of flexing sequentially from one end to the other end,
a plurality of sequential flexing means spaced apart along said flexible element and between the ends of said element to flex said flexible element sequentially from one end to the other end along said stacker end so as to align sheets in a stack as it is stacked at said end of said conveyor,
and actuating means adjacent said flexing means between the ends of said flexible element to individually sequentially actuate the respective flexing means.

4. The stack aligner as specified in claim 3, and
said flexing means including a plurality of pusher members longitudinally spaced apart along said flexible element,
and said actuating means including means pushing said pusher members sequentially along said flexible element toward the sheets in the stack.

5. The stack aligner as specified in claim 3, and
said flexing means including rotating members adjacent to and along said element,
and said actuating means including resilient means to urge said flexible element and said rotating members into operative relation.

6. The undulating stack aligner specified in claim 3, and
said flexing means including a series of spaced rotating members along said stacker end and along said element,
means to rotate said rotating members,
said rotating members being eccentric and being offset circumferentially relatively to one another to exert a pushing force on said flexible element substantially sequentially.

7. The undulating stack aligner specified in claim 3, and said support means including
said flexing means being rotating members,
a longitudinally pivotal support for a portion of said flexible elements,
and resilient means to urge the other portions of the plate toward said rotating members,
and said rotating members being offset circumferentially relatively to one another to exert pushing force on said flexible element sequentially to overcome the force of said resilient means.

8. The undulating stack aligner specified in claim 3, and
said support means including
a longitudinally pivotal support along the flexible element,
said means to flex said flexible element being a series of cams having their risers offset circumferentially relatively to one another sequentially along said flexible element,
cam followers on said flexible element opposite the respective cams,
and means to urge said cam followers and said flexible element toward said cams.

9. The undulating stack aligner specified in claim 3, and
said support means for said flexible element including yieldable support members along the lower portion of said flexible element,
and resiliently yieldable means urging the upper portion of said flexible element toward said flexing means.

10. The undulating stack aligner specified in claim 6, and
a pulley shaft on said stacker end,
and said rotating members being rotated by said pulley shaft.

11. The combination with the stacker end of a stacker conveyor, having
a pair of brackets pivoted on opposite sides of said stacker end,
back-stops,
adjustable supports to support said back-stops spaced from said stacker end for stacking sheets discharged therefrom,
of
a connecting brace extending from each bracket and being pivoted on the respective side of said conveyor,
the pivot of each bracket being located to swing the bracket toward said conveyor when forced by said back-stops,
relatively telescopingly held rods forming each connecting brace,
resiliently yieldable means to hold said rods extended and resist the turning of said brackets toward said conveyor,
a switch mounted on one of said rods,
a member on the other rod for actuating said switch when an obstruction to movement of said back-stops pivots said brackets toward said conveyor thereby telescoping said rods,
and means actuated by the actuation of said switch to raise and hold said back-stops above said obstruction.

* * * * *